US010870959B1

(12) United States Patent
Gass

(10) Patent No.: US 10,870,959 B1
(45) Date of Patent: Dec. 22, 2020

(54) SNOWPLOW BLADE ASSEMBLY

(71) Applicant: Steven Gass, Chicago, IL (US)

(72) Inventor: Steven Gass, Chicago, IL (US)

( * ) Notice: Subject to any disclaimer, the term of this patent is extended or adjusted under 35 U.S.C. 154(b) by 0 days.

(21) Appl. No.: 16/841,630

(22) Filed: Apr. 6, 2020

(51) Int. Cl.
*E01H 5/06* (2006.01)

(52) U.S. Cl.
CPC ..... *E01H 5/062* (2013.01)

(58) Field of Classification Search
CPC ..... E01H 5/062; E01H 5/066; E01H 5/065; E01H 5/061; E02F 3/815; E02F 3/8152
See application file for complete search history.

(56) References Cited

U.S. PATENT DOCUMENTS 1,333,504 A * 3/1920 Monroe ..... E02F 3/7686 172/782
1,568,439 A * 1/1926 Baxter ..... E02F 3/7686 172/784
2,594,727 A * 4/1952 Burggren ..... E02F 3/815 172/815
2,646,633 A * 7/1953 Jahn ..... E02F 3/7659 172/782
2,983,058 A * 5/1961 Hertz ..... E01H 1/105 37/272
3,231,991 A * 2/1966 Wandscheer ..... E02F 3/815 37/280
3,340,681 A * 9/1967 Strawbridge ..... A01D 34/03 56/229
3,349,507 A 10/1967 Payne
3,422,553 A 1/1969 Holloway
3,430,706 A * 3/1969 Marron ..... E02F 3/8152 172/815
3,477,151 A * 11/1969 Zanella ..... E01H 5/065 37/281
3,605,167 A * 9/1971 Martel et al. ..... A01K 1/0128 15/236.05
4,073,076 A * 2/1978 Fortune ..... E01H 5/066 293/49
4,077,139 A * 3/1978 Fagervold ..... E01H 5/067 172/784
4,372,617 A * 2/1983 Zamboni ..... E01H 4/023 172/782
4,794,710 A 1/1989 Haring
4,833,801 A 5/1989 Winter
(Continued)

*Primary Examiner* — Jamie L McGowan
(74) *Attorney, Agent, or Firm* — Mark C. Johnson; Johnson Dalal

(57) ABSTRACT

A snowplow blade assembly provides a snowplow blade that attaches to a vehicle for clearing residue from a pathway. The snowplow blade is configured to minimize structural damage caused by a pathway edge barrier, or a stationary object disposed on, or along, the pathway. A break-away section of the snowplow blade hingedly pivots, and potentially detaches with respect to a remainder of the snowplow blade when a predetermined shear stress from the pathway edge barrier or stationary object is applied. The break-away section includes a wheel roller that facilitates rolling advancement of the snowplow blade along or on the pathway edge barrier. The break-away section also forms an outer edge recess on a first side-blade end of snowplow blade. The outer edge recess is sized to enable passage of stationary objects, which prevents damage to the snowplow blade or stationary objects.

14 Claims, 9 Drawing Sheets

(56) References Cited

U.S. PATENT DOCUMENTS

| | | | | |
|---|---|---|---|---|
| 4,834,191 | A * | 5/1989 | Vecchio | E02F 3/815 172/701.1 |
| 4,899,472 | A | 2/1990 | Winter | |
| 5,636,458 | A * | 6/1997 | Drake | E01H 5/066 37/266 |
| 5,758,728 | A * | 6/1998 | Ragule | E01H 5/065 172/815 |
| 5,819,444 | A | 10/1998 | Desmarais | |
| 5,829,174 | A | 11/1998 | Hadler et al. | |
| 5,903,986 | A | 5/1999 | Parker | |
| 6,240,666 | B1 | 6/2001 | Dugas | |
| 6,594,923 | B1 | 7/2003 | Kost et al. | |
| 6,883,436 | B2 * | 4/2005 | Fuerst | E01B 27/02 104/2 |
| 6,974,890 | B1 | 12/2005 | Porso et al. | |
| 7,051,819 | B1 * | 5/2006 | Schenk | E01H 1/003 172/782 |
| 7,107,709 | B2 | 9/2006 | Hamel | |
| 7,407,016 | B1 * | 8/2008 | Kvalo | E02F 3/8152 172/784 |
| D594,882 | S | 6/2009 | Schultz | |
| 7,681,337 | B2 | 3/2010 | Watson | |
| 7,743,536 | B2 | 6/2010 | Evans et al. | |
| D799,554 | S | 10/2017 | Peterson | |
| 10,227,751 | B2 | 3/2019 | Nero et al. | |
| 10,435,864 | B2 * | 10/2019 | Holman | E01H 5/066 |
| 2009/0282706 | A1 * | 11/2009 | Barker | E01H 5/061 37/196 |
| 2010/0064554 | A1 * | 3/2010 | Ropog | E01H 5/066 37/197 |
| 2012/0311893 | A1 * | 12/2012 | Knott | E01H 5/066 37/233 |
| 2013/0232827 | A1 * | 9/2013 | Summers | E01H 5/062 37/232 |

* cited by examiner

SNOWPLOW BLADE ASSEMBLY

FIELD OF THE INVENTION

The present invention relates generally to snowplows, and, more particularly, relates to a snowplow assembly operably configured to avoid damage thereto.

BACKGROUND OF THE INVENTION

A snowplow blade is generally considered road maintenance equipment that is typically detachably coupled to a vehicle for plowing compacted ice and/or snow (or other substances) from the surface of a pathway. The snowplow blade is commonly used for removing snow and compacted ice on surfaces that regularly receive large amounts of snow and ice. The snowplow blades often have a chassis frame that can be permanently or temporarily affixed to the vehicle chassis, usually behind the vehicle front bumper. The snowplow blades typically mount to four-wheel drive vehicles, such as pickup trucks, and are then pushed through the residue to funnel and carry the residue to a desired location.

Generally, because a snowplow blade is elongated, and because the primary function of the snowplow blade is to plow the residue beyond the edge of the pathway, the ends of the snowplow blade have a tendency to forcefully engage the rough and rigid surface of the pathway, and stationary objects thereon. Also, the snowplow blade scrapes along the surface of the pathway, creating friction, slowing down plowing operations, and causing structural damage to contact surfaces, standing structures, and the plow blade or vehicle itself. It is also known in the art that the terminal ends of the snowplow blade hit stationary or standing objects along the edge of the pathway. This is often the case where the snowplow blade is a standard fully rectangular blade.

Some known devices and methods of attempting to prevent damage to snowplow blades and surrounding structures includes selectively adjusting and locking one or more sections of the snowplow blade in a desired orientation. These devices, however, still do not prevent partial or complete damage to the snowplow blade if a collision with a structure is experienced. Some known devices and methods of attempting to prevent damage to snowplow blades also provide for selective adjustability or flexing of the bottom blade of the snowplow blades (which is often replaceable). While the flexibility of the bottom blade may help prevent damage to a portion of the blade (namely the bottom), it does not prevent damage to the entire snowplow blade (namely the horizontal portion of the snowplow blade).

Therefore, a need exists to overcome the problems with the prior art as discussed above.

SUMMARY OF THE INVENTION

The invention provides a snowplow blade assembly that overcomes the hereinafore-mentioned disadvantages of the heretofore-known devices and methods of this general type and that provides a snowplow blade that mounts to a vehicle for clearing residue from a pathway. The snowplow blade is configured to minimize structural damage that can be caused by a pathway edge barrier, or a stationary object on, or along, the pathway. A break-away section of the snowplow blade hingedly pivots, and potentially detaches with respect to a remainder of the snowplow blade when a predetermined shear stress from the pathway edge barrier or stationary object is applied. The break-away section includes a wheel roller that facilitates rolling advancement of the snowplow blade along or on the pathway edge barrier. The break-away section also forms an outer edge recess on a first side-blade end of snowplow blade. The outer edge recess is sized to enable passage of stationary objects, which prevents damage to the snowplow blade and the stationary object.

With the foregoing and other objects in view, there is provided, in accordance with the invention, a snowplow blade assembly comprises a blade mounting frame comprising a first attachment end operably configured to selectively couple to a vehicle, and a second attachment end directly coupled to a snowplow blade.

The snowplow blade comprises a first side-blade end, and a second side-blade end opposing the first side-blade end. A blade length separates the first and second side-blade ends. The snowplow blade may also have an upper end and a lower end opposite the upper end. A blade height separates the upper and lower ends of the snowplow blade. The snowplow blade further comprises an inner concave surface disposed along the blade height and spanning the blade length. The concave configuration is effective for funneling residue, such as snow and ice, off the pathway.

The snowplow blade includes a break-away section that defines the first side-blade end of the snowplow blade. The break-away section has a section side edge separating the upper and lower ends. The break-away section is operably configured to selectively pivot with respect to a remainder of the snowplow blade through use of an inner side edge that pivots about a hinge.

The break-away section is hingedly joined with the remainder of the snowplow blade, pivoting between a first position and a second position along a rotation path. In the first position, the section side edge of the break-away section is in alignment with, and juxtaposed to, the inner side edge of the snowplow blade. Thus, the first position comprises the break-away section in a locked position with respect to the remainder of the snowplow blade. The first position is depicted with the snowplow blade in a linear, natural position.

The break-away section also hingedly pivots to a second position along the rotation path. The second position is configured when the section side edge of the break-away section is removed from, and angled with respect to the inner side edge of the snowplow blade. The second position is a consequence of the break-away section engaging the pathway edge barrier, such that a predetermined shear stress is applied thereto, causing the break-away section to hingedly pivot or detach from the snowplow blade.

In accordance with a further feature of the present invention, the hinge has a rotational resistance member coupled to the break-away section and the snowplow blade.

In accordance with a further feature of the present invention, the hinge comprises a spring coupled thereto and operably configured to bias the break-away section in the first position along the rotation path.

In accordance with another feature, an embodiment of the present invention includes a center axis extending longitudinally along the snowplow blade from the first side-blade end to the second side-blade end when the break-away section is disposed in the first position, the center axis on the break-away section disposed at an acute angle θ with respect to the center axis on the snowplow blade when the break-away section is disposed in the second position along the rotation path.

In accordance with another feature, an embodiment of the present invention includes a wheel roller disposed at the first side-blade end and operably configured to rotate 360° about a roller axis.

In accordance with a further feature of the present invention, the roller axis is disposed at substantially parallel orientation with respect to a hinge axis defined by the hinge about which the break-away section is operably configured to pivot. However, in other embodiments, the roller axis is disposed at an acute angle, approximately less than 30° with respect to a hinge axis.

In accordance with a further feature of the present invention, the wheel roller comprises an upper end, a lower end opposing the upper end, a wheel length separating the lower and upper ends of the wheel roller, and an outer surface disposed along the wheel length, the outer surface of the wheel roller defining a terminal outer end of the snowplow blade.

In accordance with a further feature of the present invention, the outer surface of the wheel roller is disposed behind the inner concave surface of the snowplow blade.

In accordance with a further feature of the present invention, the upper end of the snowplow blade comprises an upper edge with a first portion spanning linearly and longitudinally along the snowplow blade and a second portion, located on the break-away section, spanning downwardly toward the lower end of the snowplow blade and terminating at the first side-blade end to define an outer edge recess.

In accordance with a further feature of the present invention, the second portion of the upper edge spans curvilinear toward the lower end of the snowplow blade.

In accordance with a further feature of the present invention, the section side edge is contacting the inner side edge of the snowplow blade when in the first position along the rotation path.

Although the invention is illustrated and described herein as embodied in a snowplow blade assembly, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the snowplow blade.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
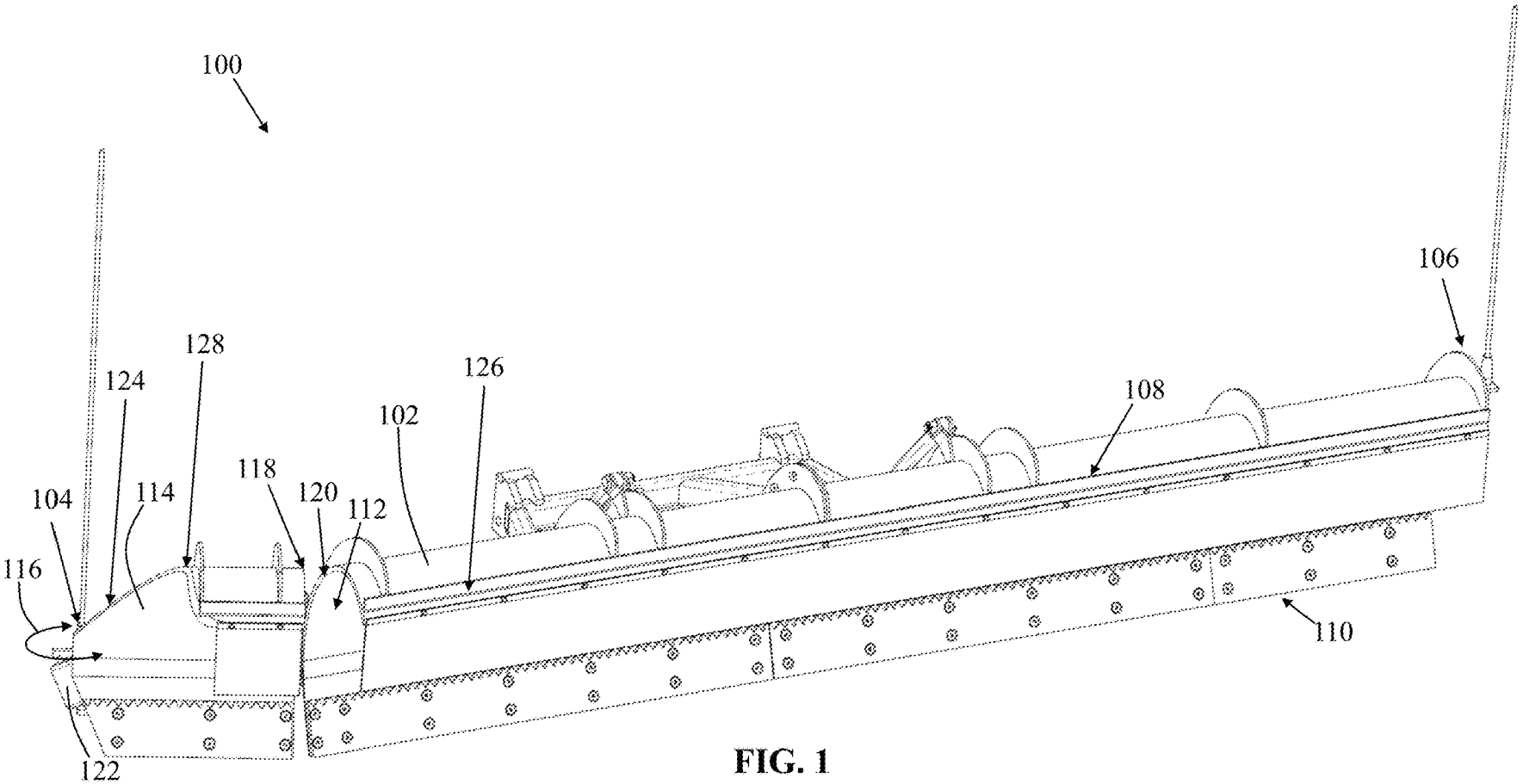
FIG. 1 is a front perspective view of the snowplow blade assembly, showing the snowplow blade hingedly pivoted to a second position, in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient snowplow assembly 100 operably configured to avoid damage thereto. Embodiments of the invention provide a snowplow blade 102 that is removably couplable or permanently coupled to a vehicle 206 for clearing snow, ice, and/or other residue from a pathway 214. In addition, embodiments of the invention provide that the snowplow blade 102 is defined by a break-away section 114 on one end. The break-away section 114 hingedly pivots away from, and potentially detaches, with respect to a remainder of the snowplow blade 102 when a predetermined shear stress is applied thereto. A wheel roller 122 is operational from one end 104 of the snowplow blade 102. The wheel roller 122 facilitates rolling advancement of the snowplow blade 102; and especially on or along a pathway edge barrier 216 of the pathway 214. The break-away section 114 also forms an outer edge recess 700 to enable passage of a stationary object 218 during operation of the snowplow blade 102. These unique features minimize damage to the snowplow blade 102, and surrounding objects during plowing operations along the pathway 214.

Referring now to FIG. 1, one embodiment of the present invention is shown in a perspective view. FIG. 1 shows several advantageous features of the present invention, but, as will be described below, the invention can be provided in several shapes, sizes, combinations of features and components, and varying numbers and functions of the components.

The first example of a snowplow blade assembly 100, as shown in FIG. 1, provides a snowplow blade 102 that attaches to a vehicle for clearing residue from a pathway 214. The snowplow blade 102 is configured to minimize structural damage that can be caused by a pathway edge barrier 216, or a stationary object 218 on, or along, the pathway 214. A break-away section 114 of the snowplow blade 102 hingedly pivots, and potentially detaches with respect to a remainder of the snowplow blade 102 when a predetermined shear stress from the pathway edge barrier 216 or stationary object 218 is applied. The break-away section 114 includes a wheel roller 122 that facilitates rolling advancement of the snowplow blade 102 along, or on, the pathway edge barrier 216. The break-away section 114 also forms an outer edge recess 700 on a first side-blade end 104 of snowplow blade 102. The outer edge recess 700 is sized to enable passage of a stationary object 218, such as a mailbox, which prevents damage to the snowplow blade 102 or stationary object 218.

Figure 2:
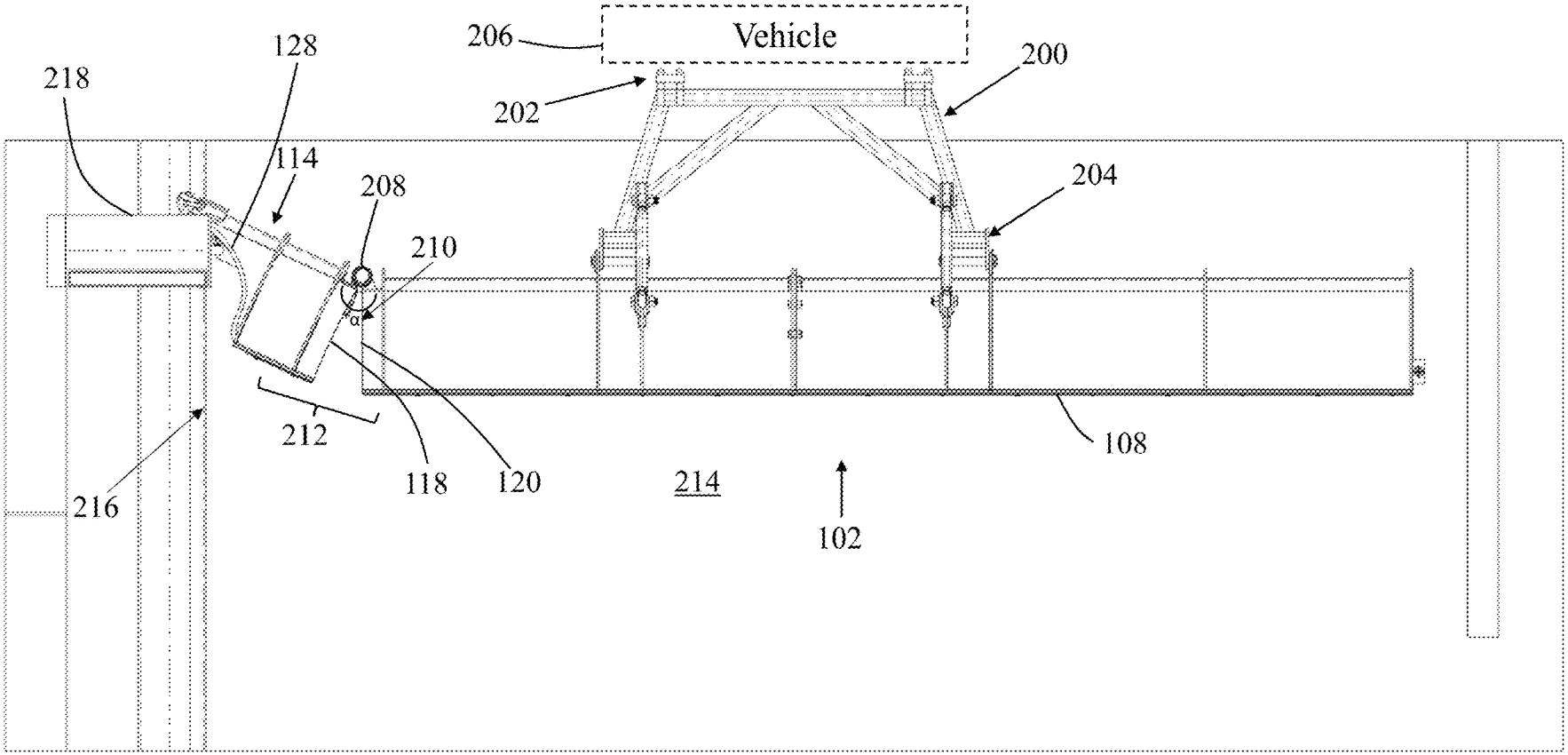
FIG. 2 is a top view of the snowplow blade assembly, showing the snowplow blade hingedly pivoted to the second position to avoid a mailbox, in accordance with the present invention.

As referenced in FIG. 2, the snowplow blade assembly 100 may utilize a blade mounting frame 200 that is configured for detachably coupling the snowplow blade 102 to a vehicle 206. The blade mounting frame 200 has a first attachment end 202 that selectively couples to a vehicle 206. The first attachment end 202 is sized to align with, and couple to a front bumper, rear bumper, or winch subassembly of the vehicle 206. The vehicle 206 may include, without limitation, a pickup truck, a semi-truck, a tractor, a snowmobile, a front-end loader, a railcar, and an automobile. As illustrated, the snowplow blade 102 couples to the front of the vehicle 206 through use of a pair of frame members bolted onto the vehicle 206.

The blade mounting frame 200 also includes a second attachment end 204 that is directly coupled to the snowplow blade 102. In this manner, the blade mounting frame 200 detachably couples from opposing ends 202, 204 to the vehicle 206 and the snowplow blade 102. This coupling relationship from either first or second attachment end 202, 204 is detachable, and may be performed manually with screws, bolts, brackets, hooks, magnets, and other vehicle accessory fastening means known in the art. In this manner, the snowplow blade 102 is universal, and adapted to couple to different types of vehicles. However, in alternative embodiments, the blade mounting frame 200 is not part of the assembly 100; whereby an off-the-shelf coupling mechanism may be used to mount the snowplow blade 102 to the vehicle 206.

Figure 3:
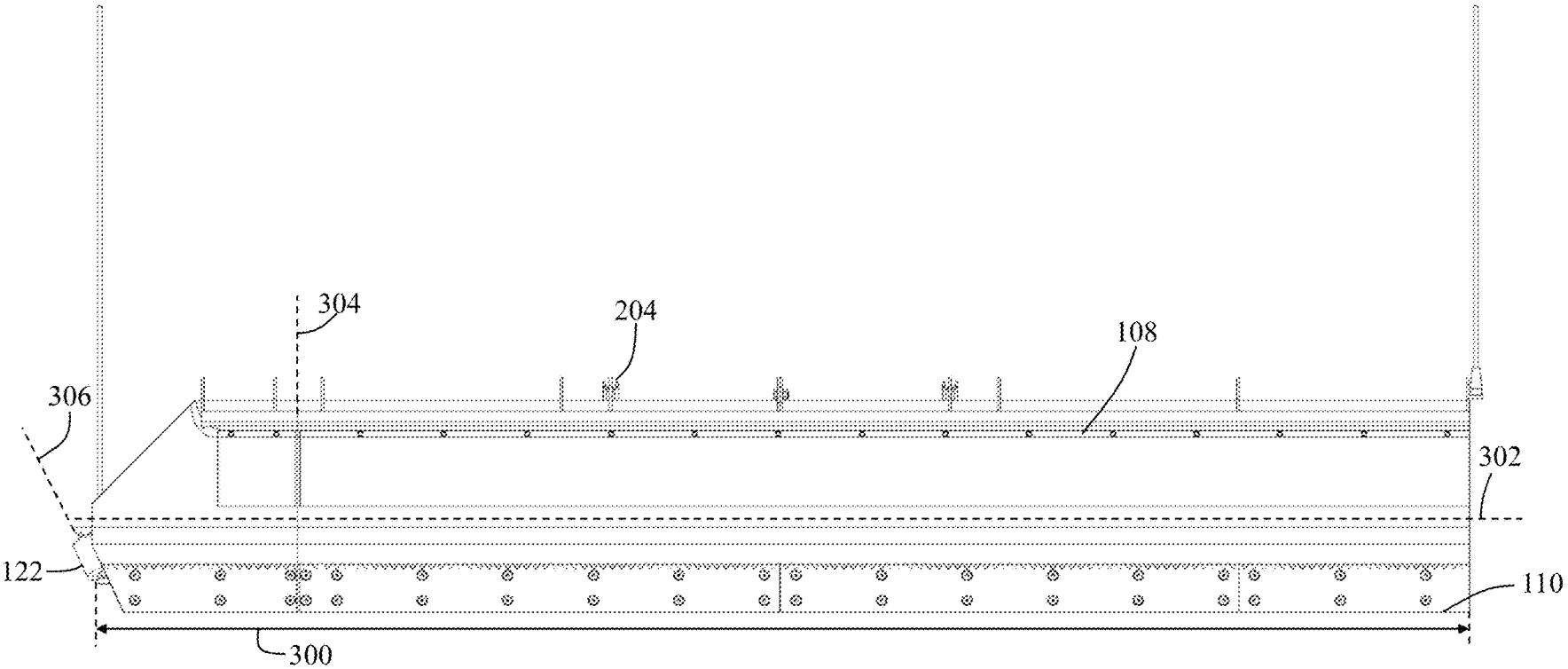
FIG. 3 is a frontal view of the snowplow blade assembly, showing the snowplow blade linearly biased to a first position, in accordance with the present invention.

Turning now to FIG. 3, the snowplow blade 102 is configured to mount to the vehicle 206, functioning primarily to remove residue, such as snow, ice, and granular members, from an outdoor surface on a pathway 214. The pathway 214 may include, without limitation, a road, highway, a driveway, a railroad, and an ice rink. For optimal deployment of the residue, the snowplow blade 102 may have a generally elongated and rectangular shape, which maximizes the surface area for carrying the residue. The snowplow blade 102 also has an inner concave surface 112 that funnels the residue into a compact shape for plowing off the surface of the pathway 214. In one non-limiting embodiment, the snowplow blade 102 removes snow and compacted ice from a roadway. Though, in other embodiments, the snowplow blade 102 may be used, without limitation, for removing ice buildup from a skating ring, gravel from a railroad, or sand from a beach.

Figure 4:
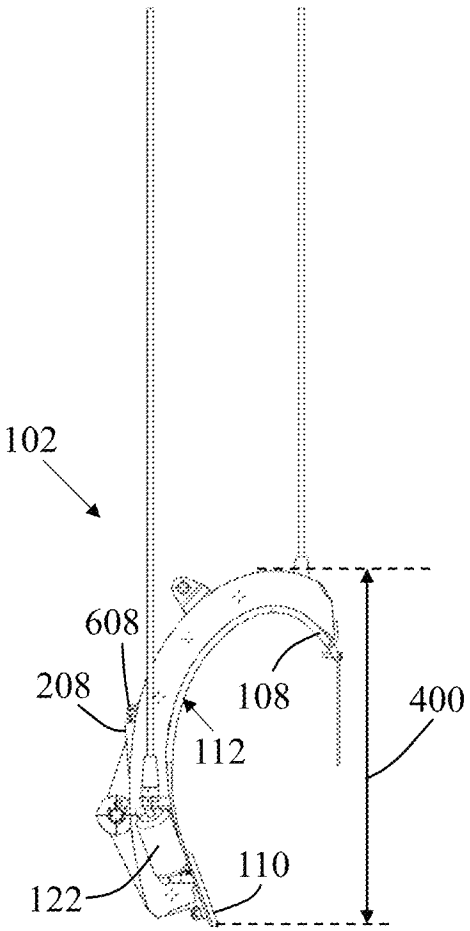
FIG. 4 is an elevated side view of the snowplow blade assembly, showing the first side-blade end of the snowplow blade, in accordance with the present invention.

As FIG. 4 illustrates, the snowplow blade 102 is defined by a first side-blade end 104, and an opposing second side-blade end 106. In some embodiments, the snowplow blade 102 mounts to the vehicle 206, such that the first side-blade end 104 is proximal to a pathway edge barrier 216 running along the pathway 214. The pathway edge barrier 216 may include, without limitation, a curb, a sidewalk, a wall, or a guard rail on a shoulder of a roadway. Thus, for a vehicle configured for a driver to sit on the left side, the first side-blade end 104 orients on the right side (passenger side) of the vehicle. This maintains the first side-blade end 104 proximal to the pathway edge barrier 216, and often, proximal to stationary objects 218, i.e., mailbox, vehicles, people, resting on or along the pathway edge barrier 216. A blade length 300 separates the first and second side-blade ends 104, 106. In one non-limiting embodiment, the blade length 300 is between 9' to 14'.

The snowplow blade also has an upper end 108, and a lower end 110 opposite the upper end 108. The upper and lower ends 108, 110 are elongated, stretching the length of the blade length 300. A blade height 400 separates the upper and lower ends 108, 110 of the snowplow blade 102. And as discussed above, the snowplow blade 102 is defined by an inner concave surface 112 that is disposed along the blade height 400 and spanning the blade length 300. The snowplow blade 102 may be oriented at an angle while plowing the residue. This angle of operational allows the inner concave surface 112 to funnel the residue away from the pathway 214, and towards the pathway edge barrier 216. Suitable materials for the snowplow blade 102 may include, without limitation, steel, iron, polyurethane, rubber, and a rigid polymer.

Figure 5:
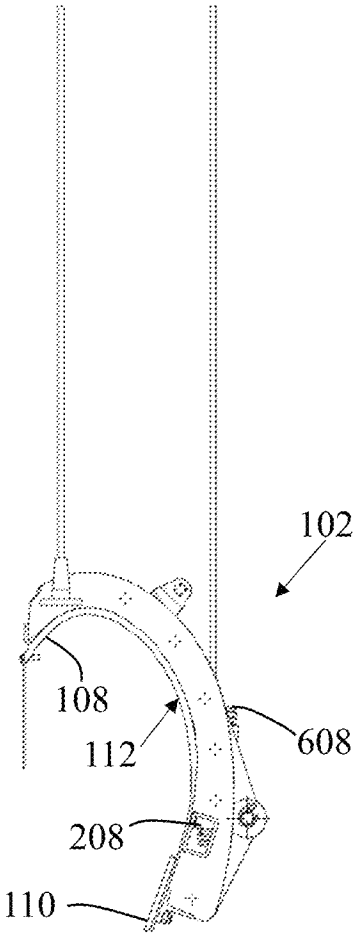
FIG. 5 is an elevated side view of the snowplow blade assembly, showing the second side-blade end of the snowplow blade, in accordance with the present invention.

Turning now to FIG. 5, the snowplow blade assembly 100 utilizes a unique break-away section 114 that hingedly joins, and potentially detaches under stress, from the first side-blade end 104 of the snowplow blade 102. The break-away section 114 may be a defined region of the first side-blade end 104. This can include the end of the snowplow blade 102 proximal to the pathway edge barrier 216. In one non-limiting embodiment, the break-away section 114 is at least one-fourths of the length of the blade length 300, relative to the remainder of the snowplow blade 102. However, in other embodiments, the ratio of lengths for the break-away section 114 to the remainder of the snowplow blade may be greater or less, depending on the plowing requirements and dimensions of the vehicle 206. In alternative embodiments, the break-away section 114 is disposed on the second side-blade end 106. In other alternative embodiments, two break-away sections are disposed on each of the blade ends 104, 106 of the snowplow blade 102.

In one possible embodiment, the break-away section 114 is defined by a section side edge 118 that separates the upper and lower ends 108, 110. The section side edge 118 hingedly mates with an opposing inner side edge 120 of the snowplow blade 102, as discussed below. The break-away section 114 is configured to selectively pivot along a rotation path 116 with respect to a remainder of the snowplow blade 102 along the inner side edge 120. In one embodiment, the break-away section 114 pivots about a hinge 208 in relation to the remainder of the snowplow blade 102, being urged between a linear first position 702 (FIG. 7), and an angled second position 212 (FIG. 2). The section side edge 118 engages the inner side edge 120 of the snowplow blade 102 in a flush relationship when in the first position 702. The section side edge 118 pivots to an acute angle 210 in relation to the inner side edge 120 of the snowplow blade 102 when in the second position 212.

It is about the hinge 208 that the break-away section 114 pivots between the first and second positions 702, 212 along the rotation path 116. The pivoting motion is in reaction to forcible engagement between the break-away section 114, and the pathway edge barrier 216 or a stationary object 218 on or along the pathway edge barrier 216. For example, as in other embodiments described herein, as the vehicle 206 drives the snowplow blade 102 forward along the pathway 214, the break-away section 114 may pivots rearwardly when striking a relatively immovable object, e.g., a concrete curb, road structure, sewer openings, etc, or when a sufficient torque is reached with respect to the hinge. For example, the hinge 200 may be disposed approximately 3 ft from the first side-blade end 104, and when a force of approximately 600-2000 lbf is experienced on the break-away section, i.e., 1800-6000 lbf·ft torque with respect to the hinge, the break-away section 114 may pivot rearwardly. This serves as a stress release mechanism to prevent damage to the snowplow blade 102.

Figure 7:
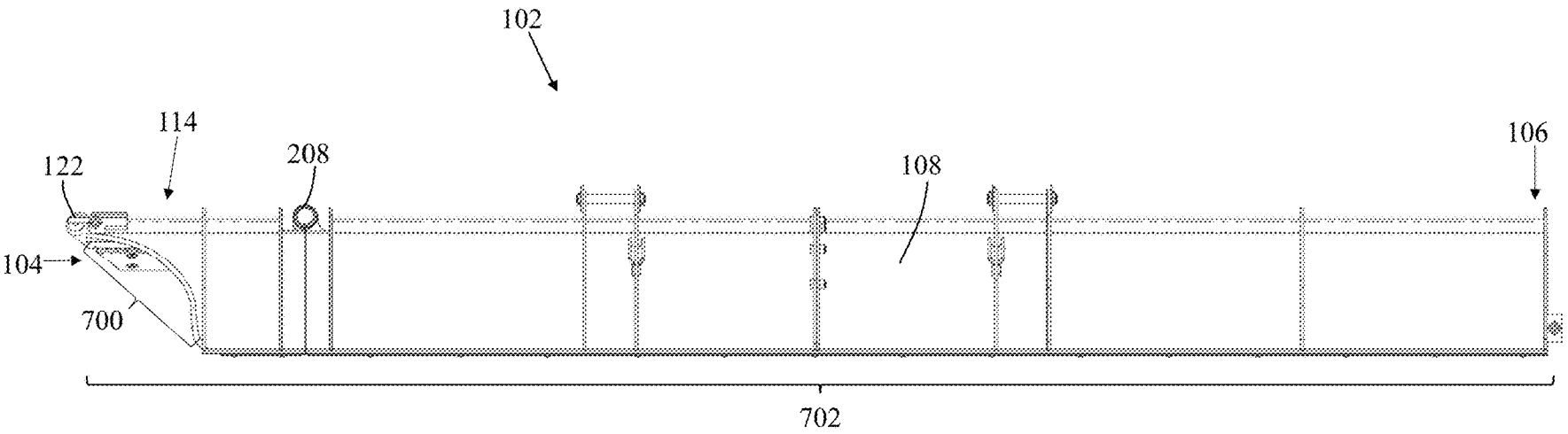
FIG. 7 is a left side view of the snowplow blade assembly, showing the edge recess at the break-away section of the snowplow blade, in accordance with the present invention.
Figure 9:
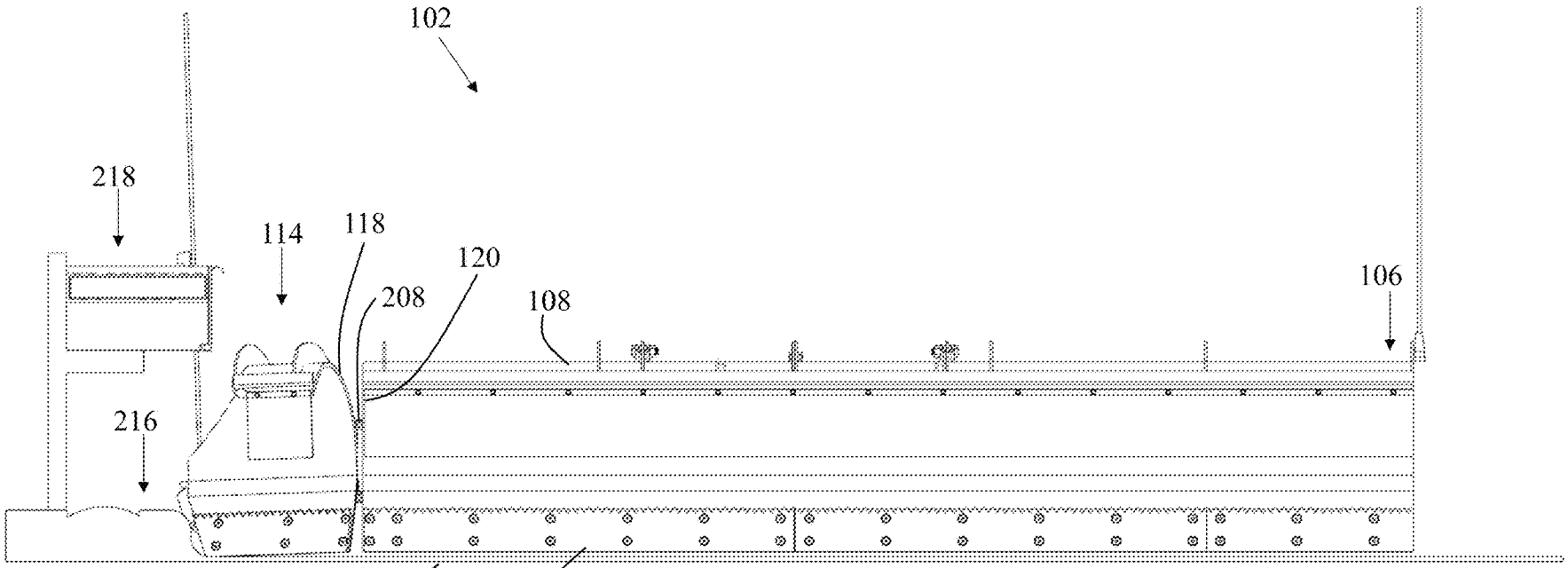
FIG. 9 is a frontal view of the snowplow blade assembly, showing the break-away section in the linear first position, and further showing the outer edge recess at the first side-blade end of the snowplow blade, in accordance with the present invention.

The position of the break-away section 114 in relation to the remainder of the snowplow blade 102 alternates between a spring-biased first position 212, and a forcibly induced second position 702. In the first position 212, the section side edge 118 of the break-away section 114 is in alignment with, and juxtaposed to, the inner side edge 120 of the snowplow blade 102. Thus, the first position 212 comprises the break-away section 114 in a locked position with respect to the remainder of the snowplow blade 102. The first position 212 is depicted in FIG. 7 and FIG. 9, showing the snowplow blade 102 in a linear, natural position. In one possible embodiment, the hinge 200 comprises a spring that is coupled thereto and operably configured to bias the break-away section 114 in the first position along the rotation path 116. This spring-biased configuration maintains the snowplow blade 102 at the optimal blade length 300 in the first position 212 for plowing residue. FIG. 3 is a frontal view of the snowplow blade assembly, showing the snowplow blade linearly biased to a first position Looking back at FIG. 1, the break-away section 114 hingedly pivots to a second position 702 along the rotation path 116. The second position 702 is formed when the section side edge 118 of the break-away section 114 is removed from, and angled with respect to the inner side edge 120 of the snowplow blade 102. The second position 702 is a consequence of the break-away section 114 engaging the stationary object 218 and/or the pathway edge barrier 216, such that a predetermined shear stress forces structural detachment of the break-away section 114 from the remainder of the snowplow blade 102.

As FIG. 2 illustrates, a center axis 302 extends longitudinally along the snowplow blade 102, from the first side-blade end 104 to the second side-blade end 106 when the break-away section 114 is disposed in the first position. And the center axis 1002 on the break-away section 114 is disposed at an acute angle 210 with respect to the center axis 302 on the snowplow blade 102 when the break-away section 114 is disposed in the second position 212 along the rotation path 116. In one non-limiting embodiment, the acute angle 210 is approximately less than 30°.

Figure 6:
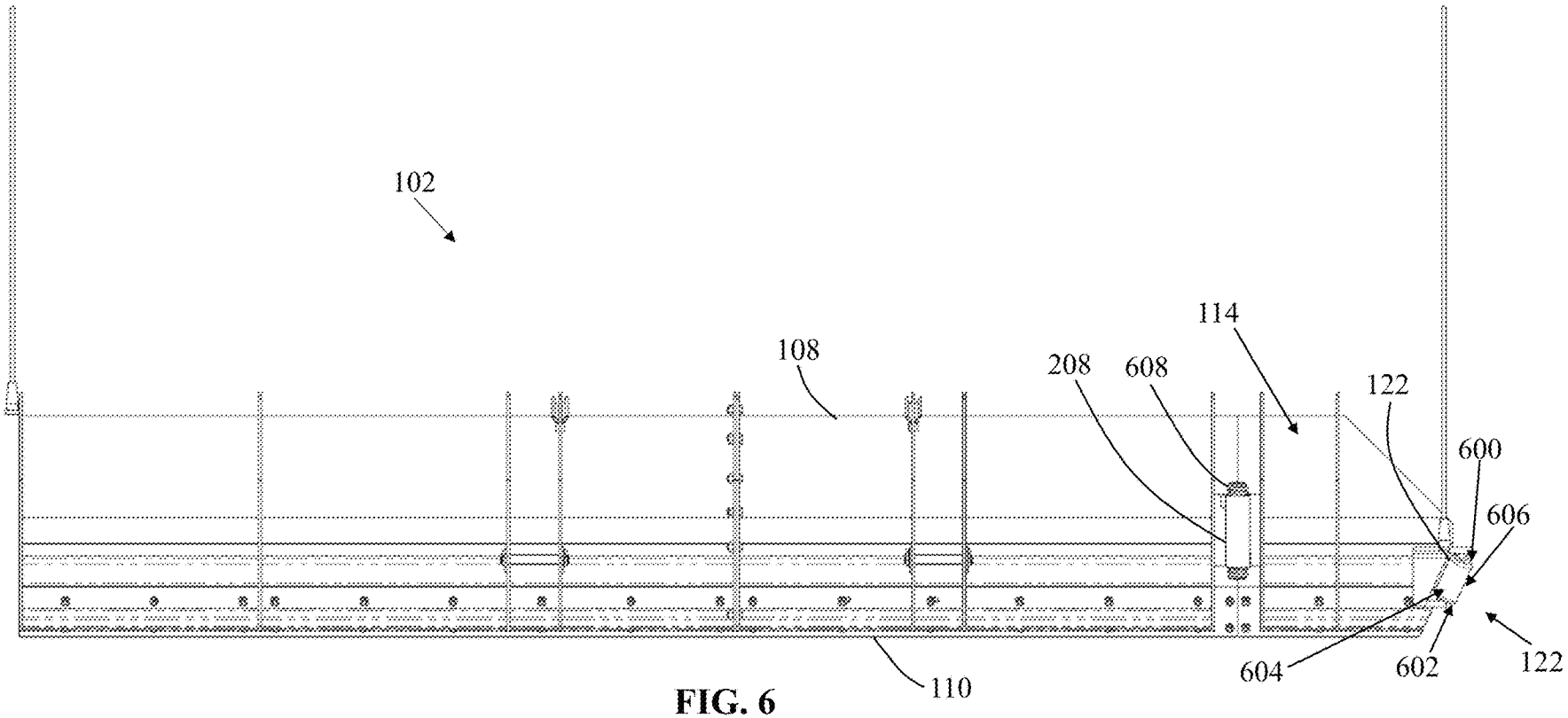
FIG. 6 is a rear view of the snowplow blade assembly, showing the snowplow blade linearly biased to a first position, in accordance with the present invention.
Figure 10:
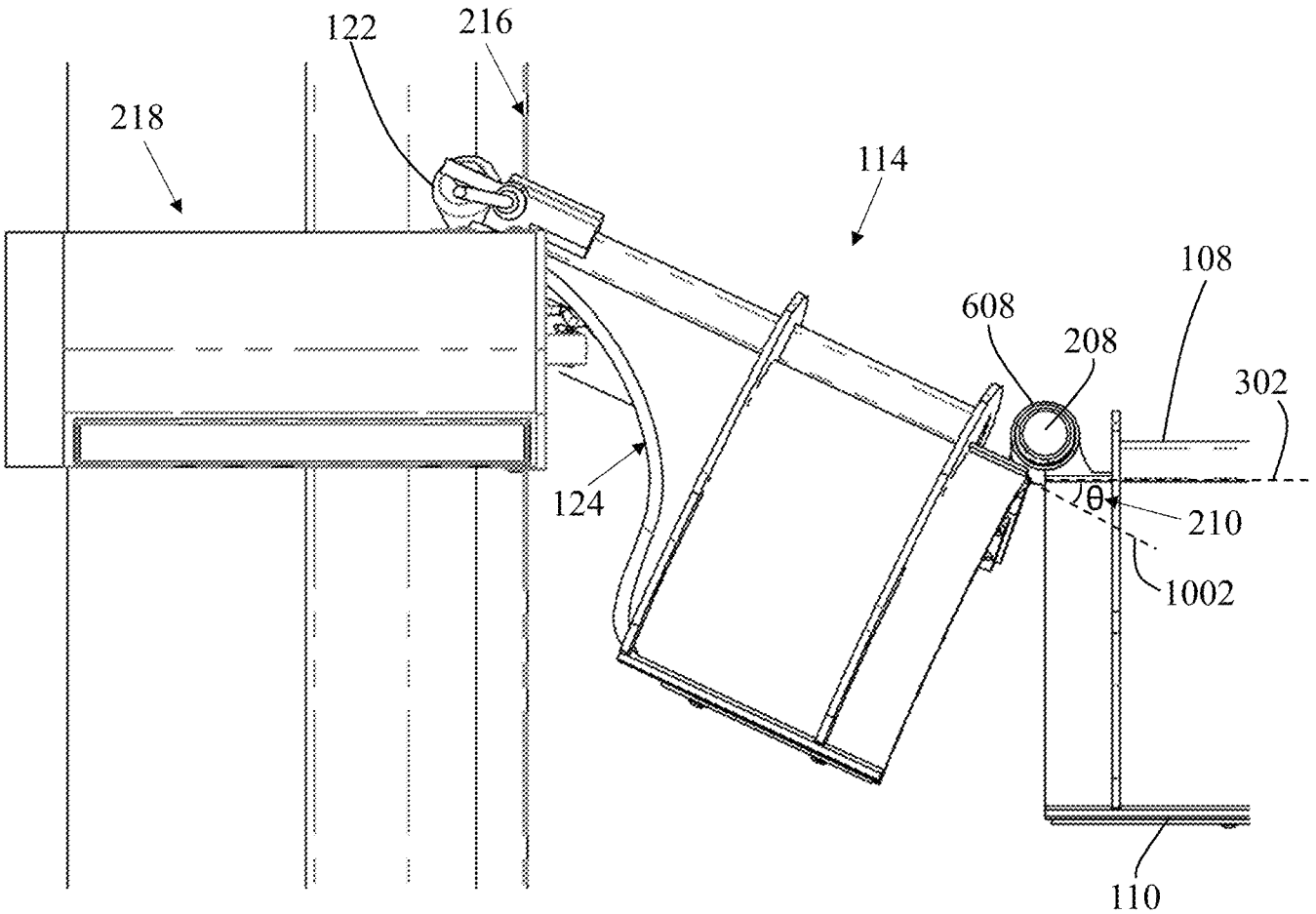
FIG. 10 is a top view of the snowplow blade assembly, showing the break-away section pivoting to a first position about a hinge and a rotational resistance member that are coupled to the break-away section, in accordance with the present invention.

In plowing operations along the pathway 214, the break-away section 114 engages structural resistance along the pathway 214, and hingedly pivots, or detaches from the snowplow blade 102 if sufficient shear stress is applied thereto. As FIG. 6 shows, the hinge 200 can include a rotational resistance member 608 that is coupled to the break-away section 114. The rotational resistance member 608 is configured to detach from the snowplow blade 102 when a predetermined shear stress is reached. The shear stress may be a torque force between 200 to 5,000-pound force (lbf), or in a more limiting embodiment, 300 to 600 lbf of torque. FIG. 10 is a top view of the snowplow blade assembly 100, showing the break-away section 114 pivoting to a second position 212 about the hinge 208. The rotational resistance member 608 is shown coupled to the break-away section 114, creating resistance to the forces pressing against the snowplow blade 102. In some embodiments, the rotational resistance member 608 may include, without limitation, a torque hinge, a spring, or a piece of material connecting both the break-away section 114 and the remainder of the snowplow blade 102.

The assembly 100 is also unique in providing mobility-enhancing means for the snowplow blade 102, on the first side-blade end 104. Thus, in one embodiment, a wheel roller 122 is operational at the first side-blade end 104 to enable enhanced mobility for that end of the snowplow blade 102 during plowing operations. The utilization of the wheel roller 122 allows the first side-blade end 104, and specifically the break-away section 114, to easily roll across the surface of the pathway edge barrier 216, i.e., curb, sidewalk. In some embodiments, the wheel roller 122 may include, without limitation, a rubber roller, a wheel, and a ball bearing. However, in alternative embodiments, the wheel roller is operational on the second side-blade end 106, or possible on both ends 104, 106 of the snowplow blade 102.

The wheel roller 122 is configured to rotate 360° about a roller axis 302, which extends orthogonally from the center of the wheel roller 122. The roller axis 302 is disposed at substantially parallel orientation with respect to a hinge axis 304 that is defined by the hinge 208 about which the break-away section 114 is operably configured to pivot. This parallel disposition is from the first position 702, where the break-away section 114 is linear with the remainder of the snowplow blade 102. However, in other embodiments, such as in the second position 212, the roller axis 302 is disposed at an acute angle 210 with respect to a hinge axis 304. In one non-limiting embodiment, the acute angle 210 from the second position 212 is approximately less than 30°.

As FIG. 6 illustrates, the wheel roller 122 comprises an upper end 600 and a lower end 602 opposing the upper end 600. In relational position to the snowplow blade 102, the upper end 600 of the wheel roller 122 may be more forward than the lower end 602 of the wheel roller 122. And the outer surface 604 of the wheel roller 122 may be disposed behind the inner concave surface 112 of the snowplow blade 102. A wheel length separates the lower and upper ends 600, 602 of the wheel roller 122. In yet other embodiments, the wheel roller 122 has an outer surface 604 that is disposed along the wheel length. The outer surface 604 of the wheel roller 122 defines a terminal outer end 606 of the snowplow blade 102. In one embodiment, a shock or dampener may also be used with the wheel roller 122 to create a smoother roll for the snowplow blade 102. The wheel roller 122 may be replaceable by removing a fastener, e.g., a pin, and may be of a very rigid metallic or other material.

Figure 8:
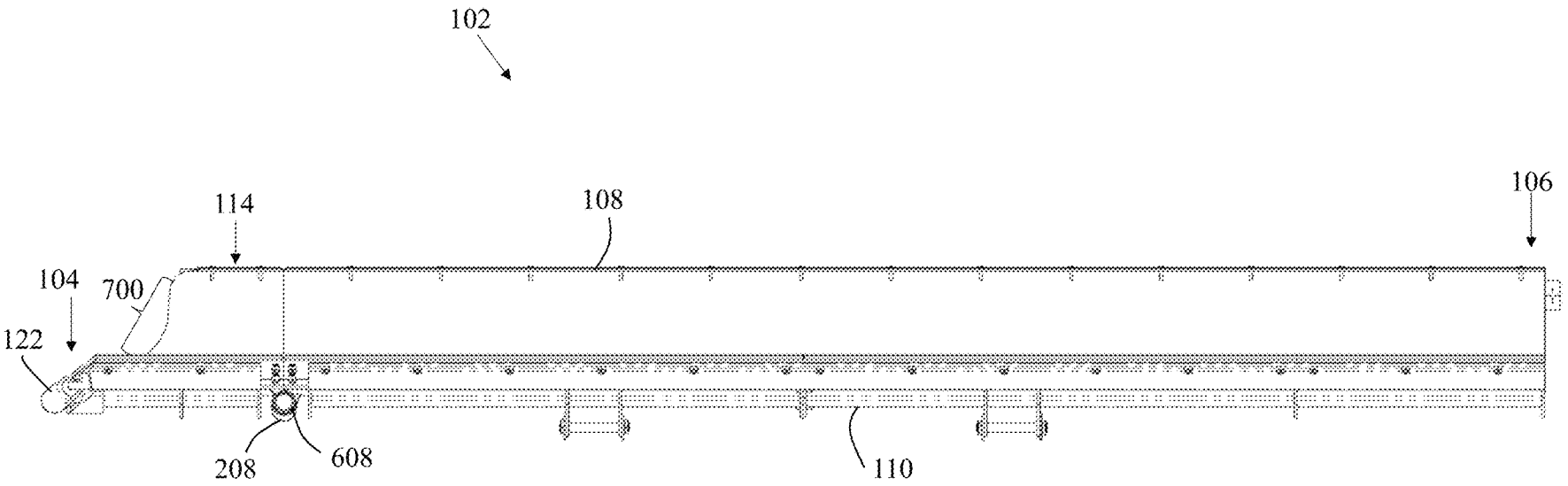
FIG. 8 is a right-side view of the snowplow blade assembly, showing the edge recess at the break-away section of the snowplow blade, in accordance with the present invention.

The assembly 100 is unique in that a predesigned cutout, or an outer edge recess 700, forms in the snowplow blade 102. FIG. 8 references the outer edge recess 700 formed in the break-away section 114 of the snowplow blade 102. Such an outer edge recess 700 is sized to help minimize contact with a stationary object 218 on the pathway 214. Thus, the upper end 108 of the snowplow blade 102 comprises an upper edge 124 with a first portion 126 that spans linearly and longitudinally along the snowplow blade 102, and a second portion 128, located on the break-away section 114, spanning downwardly toward the lower end 110 of the snowplow blade 102. The second portion 128 terminates at the first side-blade end 104 to define the outer edge recess 700. In one non-limiting embodiment, the second portion 128 of the upper edge 124 spans curvilinear toward the lower end 110 of the snowplow blade 102. The size of the outer edge recess 700 is such that a stationary object, such as a mailbox, can pass through the first side-blade end 104 of the snowplow blade 102 without contacting or causing damage to the snowplow blade 102.

In operation, the blade mounting frame 200 is coupled to a snowplow blade 102 through a first attachment end 202, and through a second attachment end 204 to a vehicle 206. Various bolts or other fasteners can be used to couple the snowplow blade 102 and the vehicle 206 to their respective sides of the blade mounting frame 200. The vehicle 206, with the newly attached snowplow blade 102, is driven along a pathway 214, with the first side-blade end 104 oriented proximally to the pathway edge barrier 216. The snowplow blade 102 may also be cocked at an angle, and parallel to the surface of the pathway 214 while being driven across the surface of the pathway 214. This standard plowing orientation is effective for funneling and carrying the residue off the pathway 214.

Continuing with the operation of snowplow blade assembly 100, a wheel roller 122 is attachable to the first side-blade end 104 of snowplow blade 102. The wheel roller 122 serves to enhance the mobility for entirety of the snowplow blade 102 during plowing operations. The utilization of wheel roller 122 allows the first side-blade end 104, and specifically the break-away section 114, to easily roll across the surface of the pathway edge barrier 216. This reduces friction with the pathway and overcomes bumps and potholes. Furthermore, the outer edge recess 700 formed in the break-away section 114 allows the snowplow blade 102 to pass close to the stationary object 218 on the pathway, without inadvertently contacting the stationary object 218. This unique cutout serves to protect the snowplow blade 102, and the stationary object 218 from damage.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features.

What is claimed is:

1. A snowplow blade assembly comprising:

a blade mounting frame with a first attachment end operably configured to selectively couple to a vehicle and a second attachment end directly coupled to a snowplow blade having:

a first side-blade end, a second side-blade end opposing the first side-blade end, and a blade length separating the first and second side-blade ends;

an upper end, a lower end opposite the upper end, and a blade height separating the upper and lower ends of the snowplow blade, the upper end of the snowplow blade having an upper edge with a first portion spanning linearly and longitudinally along the snowplow blade and a second portion and the lower end of the snowplow blade having a lower edge with a first portion spanning linearly and longitudinally along the snowplow blade and a second portion;

an inner concave surface disposed along the blade height and spanning the blade length; and a break-away section:

defining the first side-blade end of the snowplow blade;

having a section side edge separating the upper and lower ends and having an inner side edge;

operably configured to selectively pivot with respect to a remainder of the snowplow blade about a hinge to have a first position along a rotation path with the section side edge aligned with and juxtaposed to the inner side edge of the snowplow blade and a second position along the rotation path with the section side edge removed from and angled with respect to the inner side edge of the snowplow blade;

having the second portion of the upper edge located thereon that includes the upper edge spanning downwardly toward the lower end of the snowplow blade, inwardly toward the inner concave surface, and terminating at the first side-blade end to define an outer edge recess;

having the second portion of the lower edge located thereon that includes the lower edge spanning upwardly toward the upper end of the snowplow blade, inwardly toward the inner concave surface, and terminating at the first side-blade end to define an outer edge recess; and having a spring coupled thereto and a remainder of the snowplow blade and operably configured to bias the break-away section in the first position along the rotation path; and a wheel roller projecting outwardly from the first side-blade end, interposed between the outer edge recess defined by the second portion of the upper edge and the lower end of the snowplow blade, angled downwardly toward the lower edge of the snowplow blade, and operably configured to rotate 360 degrees about a roller axis.

2. The snowplow blade assembly according to claim 1, wherein the first position along the rotation path further comprises:

the break-away section in a locked position with respect to the remainder of the snowplow blade, the hinge having a rotational resistance member coupled to the snowplow blade.

3. The snowplow blade assembly according to claim 2, wherein the snowplow blade further comprises:

a center axis extending longitudinally along the snowplow blade from the first side-blade end to the second side-blade end when the break-away section is disposed in the first position, the center axis on the break-away section disposed at an acute angle with respect to the center axis on the snowplow blade when the break-away section is disposed in the second position along the rotation path.

4. The snowplow blade assembly according to claim 1, wherein:

the section side edge of the break-away section engages the inner side edge of the snowplow blade when in the first position along the rotation path.

5. The snowplow blade assembly according to claim 1, wherein:

the roller axis is disposed at an acute angle with respect to a hinge axis defined by the hinge about which the break-away section is operably configured to pivot.

6. The snowplow blade assembly according to claim 1, wherein the wheel roller further comprises:

an upper end, a lower end opposing the upper end, a wheel length separating the lower and upper ends of the wheel roller, and an outer surface disposed along the wheel length, the outer surface of the wheel roller defining a terminal outer end of the snowplow blade.

7. The snowplow blade assembly according to claim 6, wherein:

the outer surface of the wheel roller is disposed behind the inner concave surface of the snowplow blade.

8. The snowplow blade assembly according to claim 1, wherein:

the wheel roller rolls along a pathway edge barrier of a pathway.

9. The snowplow blade assembly according to claim 1, wherein:

the second portion of the upper edge spans curvilinear toward the lower end of the snowplow blade.

10. A snowplow blade assembly comprising:

a blade mounting frame with a first attachment end operably configured to selectively couple to a vehicle and a second attachment end directly coupled to a snowplow blade having:

a first side-blade end, a second side-blade end opposing the first side-blade end, and a blade length separating the first and second side-blade ends;

an upper end, a lower end opposite the upper end, and a blade height separating the upper and lower ends of the snowplow blade, the upper end of the snowplow blade having an upper edge with a first portion spanning linearly and longitudinally along the snowplow blade and a second portion and the lower end of the snowplow blade having a lower edge with a first portion spanning linearly and longitudinally along the snowplow blade and a second portion;

an inner concave surface disposed along the blade height and spanning the blade length; and a break-away section:

defining the first side-blade end of the snowplow blade, having a section side edge separating the upper and lower ends, and operably configured to selectively pivot with respect to a remainder of the snowplow blade having an inner side edge and about a hinge to have a first position along a rotation path with the section side edge aligned with and juxtaposed to the inner side edge of the snowplow blade and with a second position along the rotation path with the section side edge removed from and angled with respect to the inner side edge of the snowplow blade, the hinge comprising a spring coupled thereto and operably configured to bias the break-away section in the first position along the rotation path;

having the second portion of the upper edge located thereon that includes the upper edge spanning downwardly toward the lower end of the snowplow blade, inwardly toward the inner concave surface, and terminating at the first side-blade end to define an outer edge recess; and having the second portion of the lower edge located thereon that includes the lower edge spanning upwardly toward the upper end of the snowplow blade, inwardly toward the inner concave surface, and terminating at the first side-blade end to define an outer edge recess; and a wheel roller disposed at the first side-blade end, projecting outwardly from the first side-blade end, interposed between the outer edge recess defined by the second portion of the upper edge and the lower end of the snowplow blade, angled downwardly toward the lower edge of the snowplow blade, and operably configured to rotate 360 degrees about a roller axis.

11. The snowplow blade assembly according to claim 10, wherein the upper end of the snowplow blade further comprises:

the outer edge recess sized and configured to enable passage of a stationary object therethrough.

12. The snowplow blade assembly according to claim 11, wherein:

the roller axis is disposed at an acute angle with respect to a hinge axis defined by the hinge about which the break-away section is operably configured to pivot.

13. The snowplow blade assembly according to claim 12, wherein the wheel roller further comprises:

an upper end, a lower end opposing the upper end, a wheel length separating the lower and upper ends of the wheel roller, and an outer surface disposed along the wheel length, the outer surface of the wheel roller defining a terminal outer end of the snowplow blade.

14. A snowplow blade assembly comprising:

a blade mounting frame with a first attachment end operably configured to selectively couple to a vehicle and a second attachment end directly coupled to a snowplow blade having:

a first side-blade end, a second side-blade end opposing the first side-blade end, a blade length separating the first and second side-blade ends;

an upper end comprising an upper edge with a first portion spanning linearly and longitudinally along the snowplow blade, the upper edge further having a second portion, a lower end of the snowplow blade opposite the upper end of the snowplow blade and having a lower edge with a first portion spanning linearly and longitudinally along the snowplow blade and a second portion, and the snowplow blade having a blade height separating the upper and lower ends of the snowplow blade;

an inner concave surface disposed along the blade height and spanning the blade length; and a break-away section:

defining the first side-blade end of the snowplow blade;

having a section side edge separating the upper and lower ends;

operably configured to selectively pivot with respect to a remainder of the snowplow blade having an inner side edge and about a hinge to have a first position along a rotation path with the section side edge aligned with and juxtaposed to the inner side edge of the snowplow blade and to have a second position along the rotation path with the section side edge removed from and angled with respect to the inner side edge of the snowplow blade, the hinge comprising a spring coupled thereto and operably configured to bias the break-away section in the first position along the rotation path;

having the second portion of the upper edge located thereon that includes the upper edge spanning downwardly toward the lower end of the snowplow blade, inwardly toward the inner concave surface, and terminating at the first side-blade end to define an outer edge recess;

having the second portion of the lower edge located thereon that includes the lower edge spanning upwardly toward the upper end of the snowplow blade, inwardly toward the inner concave surface, and terminating at the first side-blade end to define an outer edge recess; and a wheel roller projecting outwardly from the first side-blade end, interposed between the outer edge recess defined by the second portion of the upper edge and the lower end of the snowplow blade, angled downwardly toward the lower edge of the snowplow blade, and operably configured to rotate 360 degrees about a roller axis.

* * * * *